United States Patent [19]

Hauser

[11] 4,353,679

[45] Oct. 12, 1982

[54] FLUID-COOLED ELEMENT

[75] Inventor: Ambrose A. Hauser, Wyoming, Ohio

[73] Assignee: General Electric Company, Cincinnati, Ohio

[21] Appl. No.: 709,918

[22] Filed: Jul. 29, 1976

[51] Int. Cl.[3] ..... F01D 9/02; F01D 5/18

[52] U.S. Cl. ..... 415/115; 415/1; 165/47

[58] Field of Search ..... 165/47; 415/117, 115, 415/116, 178; 416/95; 60/39.66

[56] References Cited

U.S. PATENT DOCUMENTS

| | | | |
|---|---|---|---|
| 3,449,189 | 6/1969 | Hutch | 154/222 |
| 3,515,499 | 6/1970 | Beer et al. | 416/95 |
| 3,609,057 | 9/1971 | Radtke | 416/95 |
| 3,628,880 | 12/1971 | Smuland et al. | 415/115 |
| 3,742,705 | 7/1973 | Sifford | 415/117 |
| 3,800,864 | 4/1974 | Hauser et al. | 165/47 |
| 3,945,758 | 3/1976 | Lee | 415/115 X |
| 4,012,167 | 3/1977 | Noble | 416/95 X |
| 4,017,213 | 4/1972 | Przirembel | 416/97 |

FOREIGN PATENT DOCUMENTS

| | | | |
|---|---|---|---|
| 488302 | 11/1952 | Canada | 415/115 |
| 1604143 | 7/1971 | France . | |
| 2316440 | 1/1977 | France . | |
| 1188401 | 4/1970 | United Kingdom | 416/95 |

*Primary Examiner*—William R. Cline
*Assistant Examiner*—Theophil W. Streule, Jr.
*Attorney, Agent, or Firm*—Robert C. Lampe, Jr.; Derek P. Lawrence

[57] ABSTRACT

A fluid-cooled element for partially defining hot gas flow passage extending upstream and downstream of a minimum area throat. A serpentine conduit of fluid communication with a coolant source routes cooling fluid within the downstream portion of the element wall bounding the hot gas passage to an internal pocket upstream of the throat. The coolant is thereafter exhausted upstream of the throat as a film over the wall. The upstream wall portion is cooled by the known impingement and film-cooling technique resulting in an element wherein all of the coolant enters the hot gas passage in a low Mach number region upstream of the throat, thereby minimizing momentum losses due to mixing. In the preferred embodiment, the passage throat is defined by a plurality of turbine nozzle vanes, the fluid-cooled element comprising a nozzle band thereof. Flanges support the nozzle within a gas turbine engine and are located upstream of the nozzle throat so as to provide a barrier which minimizes coolant leakage downstream of the throat.

10 Claims, 5 Drawing Figures

FLUID-COOLED ELEMENT

The invention herein described was made in the course of or under a contract, or sub-contract thereunder, with the U.S. Department of the Air Force.

BACKGROUND OF THE INVENTION

This invention relates to cooling systems and, more particularly, to cooling systems for use in gas turbine engines.

Cooling of high temperature components in gas turbine engines is one of the most challenging problems facing engine designers today, particularly as it relates to the turbine portions of the engine where temperatures are most severe. While improved high temperature materials have been developed which partially alleviate the problem, it is clear that complete reliance on advanced technology materials will not be practical for the foreseeable future. One reason is that these advanced materials contemplate expensive manufacturing techniques or comprise alloys of expensive materials. Thus, the product, though technically feasible, may not be cost-effective. Additionally, as gas turbine temperatures are increased to higher and higher levels, it is clear that no contemplated material, however exotic, can withstand such an environment without the added benefit of fluid cooling. Fluid cooling, therefore, can permit the incorporation of more cost-effective materials into present-day gas turbine engines and will permit the attainment of much higher temperatures (and, therefore, more efficient engines) in the future.

Various fluid cooling techniques have been proposed in the past, commonly classified as either convection, impingement or film cooling. All of these methods have been tried in gas turbine engines, both individually and in combination, utilizing the relatively cool pressurized air from the compressor portion of the engine as the cooling fluid. Such prior art concepts are discussed in U.S. Pat. 3,800,864-Hauser et al, which is assigned to the assignee of the present invention. One problem associated with fluid cooling is to reduce the system losses, thereby reducing the quantity of propulsive fluid (air) utilized for such nonpropulsive purposes. In the current practices, where fluid cooling has been utilized to augment the inherent high-temperature material characteristics, it has been necessary to absorb the performance penalty incurred when the coolant is injected back into the propulsive stream at locations where performance losses result. For example, it is not uncommon to find that in fluid-cooled turbines the coolant is discharged at some high Mach number region downstream of the nozzle throat such as the nozzle band trailing edge. This type of mixing of the low velocity coolant with the high velocity hot gas stream leads to momentum losses which produce performance penalties.

SUMMARY OF THE INVENTION

Accordingly, it is the primary object of the present invention to provide an improved cooling system for an element defining a hot gas passage having a throat.

It is another object of the present invention to provide a system which reduces mixing losses between the fluid coolant and the hot gas stream.

It is yet another object of the present invention to provide a method of cooling an element defining a hot gas passage having a throat.

These and other objects and advantages will be more clearly understood from the following detailed description, drawings and specific examples, all of which are intended to be typical of, rather than in any way limiting to, the scope of the present invention.

Briefly stated, the invention relates to the design of a fluid cooling scheme incorporating film, convection, and impingement cooling which minimizes the injection of fluid coolant into areas of a turbine where significant performance losses may result. In particular, the invention relates to injecting all film cooling air (other than that used to cool the vanes) into the turbine nozzle upstream of the nozzle throat where the gas stream Mach number is as low as possible. This reduces the momentum losses as the gas stream and coolant streams mix, and assures that all of the turbine nozzle flow (coolant plus hot gas stream) achieves the same nozzle discharge velocity and air angle by passing through the nozzle throat.

The above objectives are accomplished in an element such as a turbine nozzle band defining a hot gas passage having a throat by first providing the element with a passage-defining wall, the wall having a first portion upstream of the throat and a second portion downstream of the throat. The wall portion downstream of the throat is provided with an internal serpentine cooling conduit which routes cooling fluid throughout the downstream portion where it cools by convection. The cooling conduit terminates in an internal pocket upstream of the passage throat, and apertures are provided to exhaust the cooling fluid from the pocket as a film over the wall. Preferably, the portion of the wall furthest downstream is the first to be cooled by the serpentine conduit to compensate for the progressive reduction in film effectiveness in the downstream direction. In the example of a gas turbine engine nozzle, the downstream wall cooling fluid is exhausted upstream of the nozzle throat where the hot stream Mach number is as low as possible. The remaining wall portion upstream of the throat is cooled by the preferred impingement-film technique thereby minimizing losses since all of the coolant films are exhausted in a relatively low Mach number region prior to passing through the nozzle throat.

A flange beneath the wall partially defines a cooling fluid passage in fluid communication with the serpentine conduit, the flange comprising a partition substantially isolating the downstream wall portion from the cooling fluid passage. Thus, cooling fluid leakage into the hot gas passage downstream of the throat is minimized. In the preferred embodiment of a gas turbine engine nozzle, this nozzle may be partially supported within the engine from the flange.

DESCRIPTION OF THE DRAWINGS

While the specification concludes with claims particularly pointing out and distinctly claiming the subject matter which is regarded as part of the present invention, it is believed that the invention will be more fully understood from the following description of the preferred embodiment which is given by way of example with the accompanying drawings in which:

DESCRIPTION OF THE PREFERRED EMBODIMENT

Figure 1:
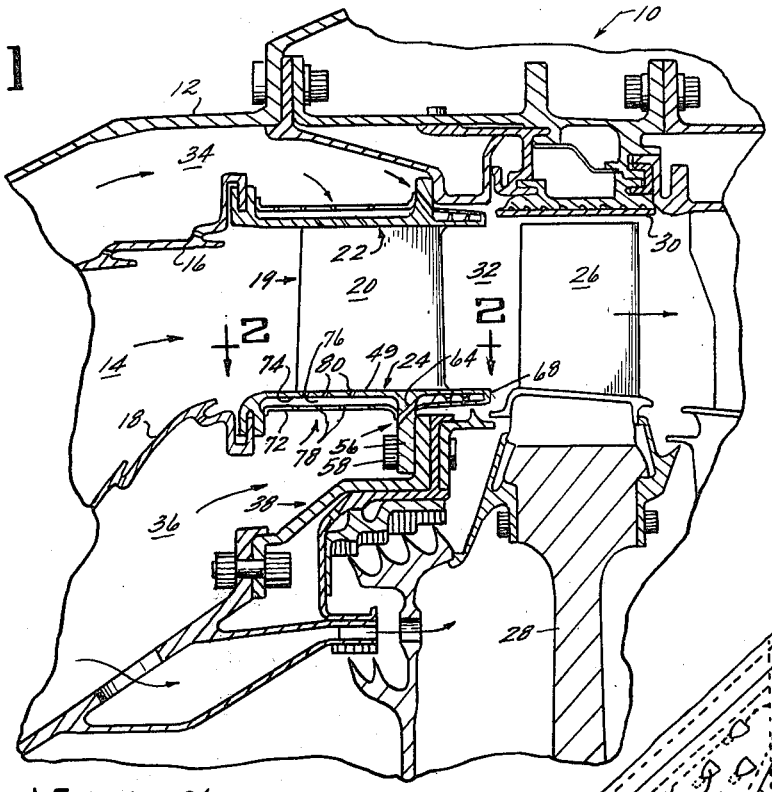
FIG. 1 is a partial cross-sectional view of a portion of a gas turbine engine incorporating the present invention.

Referring to the drawings wherein like numerals correspond to like elements throughout, attention is first directed to FIG. 1 depicting a partial cross-sectional view of a portion of a gas turbine engine generally designated 10 and including a structural frame 12. The engine includes a combustion chamber 14 defined between an outer liner 16 and an inner liner 18. Immediately downstream of the combustor is a nozzle 19 comprising an annular row of generally radial turbine inlet nozzle vanes 20 carried by segmented outer nozzle bands 22 and similarly segmented inner nozzle bands 24. Downstream of nozzle vanes 20 is disposed an annular row of turbine buckets 26 carried by a rotatable disc 28 which, in turn, is drivingly connected to a compressor, not shown, in the usual manner of a gas turbine engine. Encircling the buckets 26 is an annular shroud 30.

A hot gas passage 32 is thus defined between the outer and inner nozzle bands 22 and 24, respectively, the passage extending downstream through the turbine bucket row 26. It may be appreciated that shrouds 22 and 24 are subjected to intense heat associated with the products of combustion exiting combustor 14 and flowing through the passage from left to right in FIG. 1, and it is toward the effective and efficient cooling of such elements that the present invention is particularly directed.

Accordingly, cooling fluid passages 34, 36 are defined toward the radially outward and inward sides, respectively, of hot gas passage 32. Passage 34 is defined between combustor liner 16 and frame 12 while passage 36 is defined between combustor liner 18 and inner support structure designated generally at 38. As is well understood in the art, cooling air is fed to the two passages 34 and 36 from an upstream compressor or fan (not shown) to provide a supply of cooling air for cooling the rear portions of the engine including the elements now to be described.

The description of the cooling system of the present invention will now be directed to the element consisting of the radially inward nozzle band 24, a representative fluid-cooled element partially defining a representative hot gas flow path. It may be seen and appreciated that the present invention is readily adaptable with any similar element so situated. Thus, for the purpose of example, the cooling system of the present invention has been depicted in FIG. 1 as being incorporated not only in inner nozzle band 24, but also in outer nozzle band 22.

Figure 2:
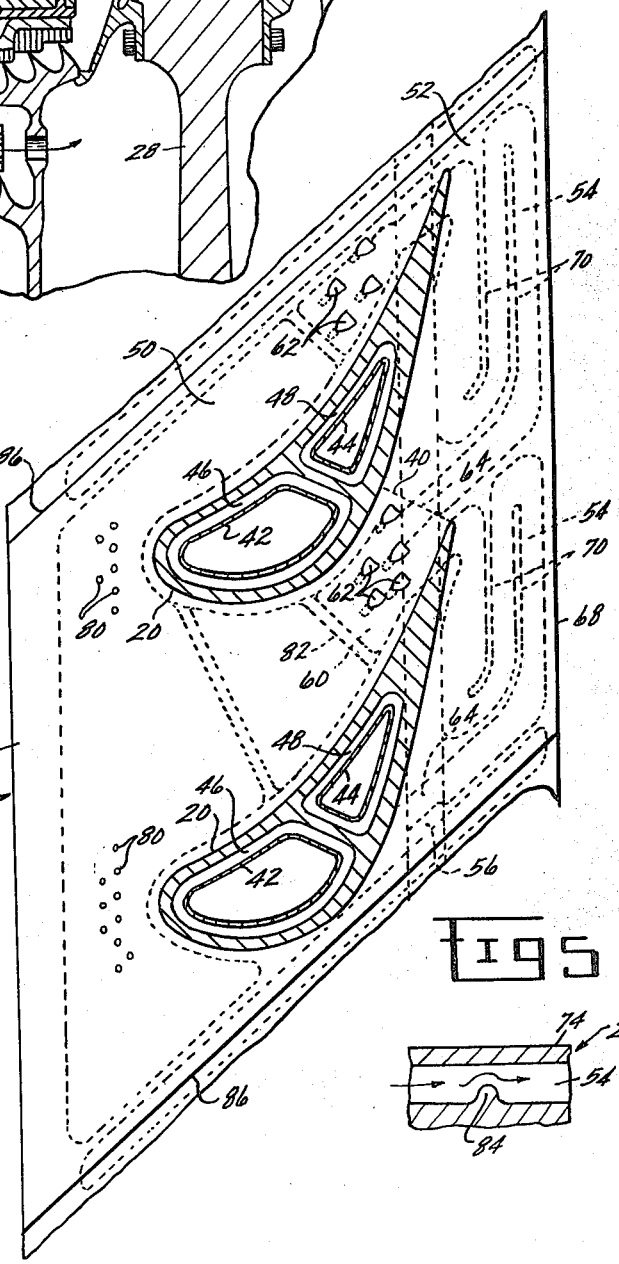
FIG. 2 is a plan view of a nozzle band segment taken along line 2—2 of FIG. 1 and incorporating elements of the present invention.

Referring now to FIG. 2 wherein a portion of element 24 is shown in plan form, an adjacent pair of nozzle vanes 20 are shown mounted thereupon, the vanes adapted to turn the flow within passage 32. The adjacent pair of vanes define therebetween a minimum passage area, or throat, 40. It is well known that the velocity of the hot gases increases to a maximum value at the nozzle throat and as noted earlier, it is desirable from a performance view to inject all film cooling air into the nozzle at a location where the gas stream Mach number (related to the velocity) is as low as possible. In this manner, the momentum losses as the hot gas stream and coolant streams mix is as low as possible. Furthermore, if the injection occurs upstream of the throat, all of the nozzle flow (hot gas plus coolant) achieves the same nozzle discharge velocity and angle as it passes through the nozzle throat. This increases the overall efficiency as relates to the succeeding blade row 26. It should be noted that vanes 20 are provided with a pair of inserts 42, 44 inserted within contoured internal cavities 46, 48, respectively, of the type taught in U.S. Pat. No. 3,715,170 to Savage et al, which is assigned to the assignee of the present invention. Briefly, cooling air from passages 34 or 36 passes to the inserts and is discharged therefrom through a multiplicity of holes (not shown) to impinge the cavity walls and enhance the convection cooling thereof.

Figure 3:
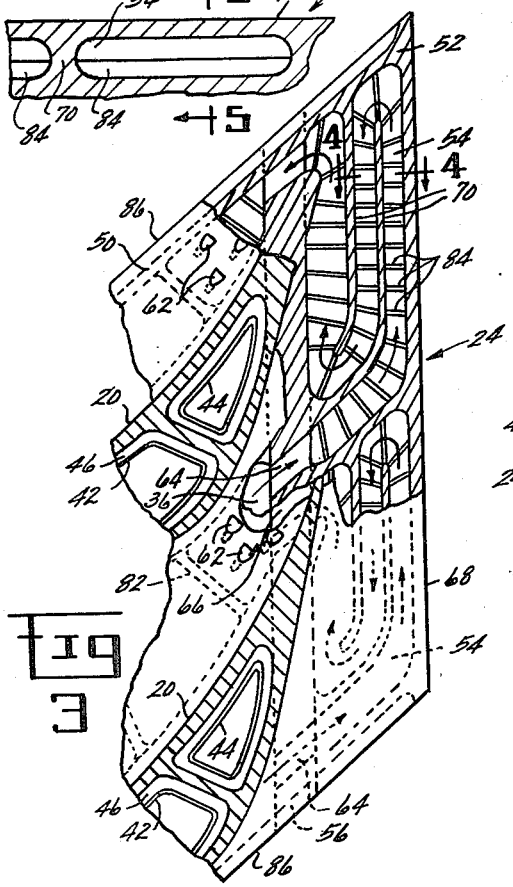
FIG. 3 is a partial cut-away view of a portion of the nozzle band segment of FIG. 2.

Continuing now with FIGS. 2 and 3, element 24 is shown to include a flow path-defining wall 49 comprises two portions, a first portion 50 upstream of the throat 40 and a second portion 52 downstream of the throat. For reasons to be discussed hereafter, the division between upstream and downstream portions is generally coincident with a load-bearing flange 56 protruding inwardly from wall 24, the flange being connected to the support structure as by bolted connection 58 for the purpose of mounting the nozzle with the engine. The downstream wall portion is provided with a plurality of internal serpentine conduits 54 (here two in number) in fluid communication with passage 36 which, in turn, is essentially upstream of the throat. Each conduit terminates in a pocket 60 within the wall portion upstream of the throat from which the cooling air is exhausted through means including a plurality of apertures 62 as a cooling film along the face of wall 49 bounding the hot gas passage. While it is not necessary to have the conduit terminate in a pocket, it is a matter of convenience since it provides a means for spreading the exhausted cooling fluid over a larger wall area. As is most clearly shown in FIG. 3, cooling air enters the serpentine conduit through an aperture 64 provided in flange 56, is circulated throughout the downstream wall portion and thereafter passes through another aperture 66 in flange 56 to pocket 60. Apertures 64 and 66 may be either laterally or, as shown herein, radially separated from each other.

The quantity of air, the number of serpentine passages, and the actual location of the conduit will be a function of the thermal environment, allowable wall metal temperature, and thermal gradients. However, since the effectiveness of film cooling generally decreases in the downstream direction, the downstream-most portion of wall 24 will be subjected to the highest temperature. To compensate, it is desirable to locate the maximum convection cooling at that point. Accordingly, the first loop of the serpentine conduit is located near the wall trailing edge 68, the conduit making a series of essentially 180° turns to pocket 60. Such a configuration produces the lowest thermal gradient system, both from top to bottom and upstream to downstream with regard to wall 49. In fact, the webs 70 partially defining the conduit will contribute to the flow of heat from the hot to cold side of the wall to further reduce the thermal gradient therebetween. The location of pocket 60 and, more particularly, apertures 62 must be such that there is a sufficient static pressure differential to drive the cooling system while at the same time realizing that it is desirable to exhaust at as high a gas stream static pressure as is possible to reduce mixing losses. Therefore, there is an inherent balancing which must be made for each application of the inventive concept as taught herein. Clearly, in operation, all air used for the cooling of the downstream wall portion is exhausted into hot gas passage 32 upstream of the throat, thereby significantly reducing losses and improving turbine efficiency.

Figure 4:
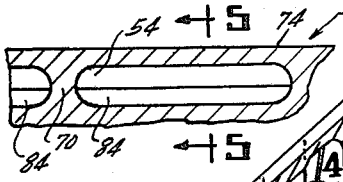
FIG. 4 is an enlarged partial cross-sectional view of a portion of the present invention taken along line 4—4 of FIG. 3.
Figure 5:
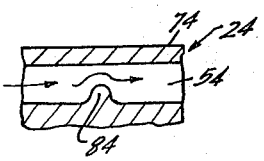
FIG. 5 is a partial cross-sectional view taken along line 5—5 of FIG. 4 further depicting a portion of the present invention.

As shown in FIGS. 4 and 5, in order to enhance the convective cooling capability within conduit 54 means to promote turbulence such as turbulence promoters 84 may be provided which span the conduit on the hot gas side thereof. The number and location of these turbulence promoters will also be a function of the particular nozzle design.

The upstream wall portion 50 may be cooled by any of several known methods, preferably by the known impingement-film cooling technique as taught by the aforementioned U.S. Pat. No. 3,800,864. Briefly, as shown in FIG. 1, a liner 72 bounding passage 36 is spaced from face 74 of wall 49 to partially define a plenum 76 therebetween. A plurality of apertures 78 provides means for introducing cooling air from the passage into the plenum and into impingement upon wall face 74 to improve the convection cooling thereof. Apertures 80 forming an acute angle with respect to the wall provide means for exhausting the cooling air as a film over the wall. Ribs 82 extending radially between liner 72 and wall 24 serve to partially define the pocket and to isolate the pocket from plenum 76. Thus, it is clear that all nozzle wall coolant is discharged upstream of the nozzle throat at 40 for maximum efficiency.

Another significant aspect of the present invention relates to the location of flange 56. Since the flange is located no further aft (i.e., in the downstream direction) than the throat location, it is clear that any coolant leakage around element 24 from passage 36 must enter the hot gas passage 32 upstream of the throat. For example, consider wall 49 to be segmented, adjacent segments abutting each other along mutually opposing faces 86. Seals of a known variety (not shown) inserted between faces 86 at flange 56, and in cooperation with flange 56, substantially isolate passages 36 from the downstream wall portion 52. While it is most desirable to totally preclude leakage from passage 36 in order to conserve and reduce coolant flow, if leakage is to occur it is best confined to the upstream wall portion since the Mach number is the lowest at that location. Furthermore, any such leakage will eventually pass through vanes 20, a desirable characteristic as previously noted. Thus, flange 56 functions, in part, as a barrier to downstream flow leakage from passage 36.

It will become obvious to one skilled in the art that certain changes can be made to the above-described invention without departing from the broad inventive concepts thereof. For example, the present embodiment in a gas turbine engine nozzle is not meant to be in any way limiting since any wall element partially defining a hot gas passage having a throat may be fluid cooled by the method taught herein, the essential steps being routing cooling fluid through the walls downstream of the throat, further routing the cooling fluid back upstream of the throat and exhausting the cooling fluid into the hot gas passage upstream of the throat. A turbine shroud cast integral with, or otherwise joined to, the outer nozzle band may also be cooled in accordance with the present invention by discharging the shroud and band cooling air upstream of the nozzle throat. Additionally, while the present invention has been shown to be incorporated within a stationary hot gas passage defining wall, it is equally applicable to rotating or otherwise movable walls. It is intended that the appended claims cover these and all other variations of the present invention's broader inventive concepts.

Having thus described the invention, what is claimed as novel and desired to be secured by Letters Patent of the United States is:

1. The nozzle band as recited in claim 22 wherein said wall is segmented into sectors, the circumferential extremities of which are provided with seals to preclude substantial leakage of cooling fluid from said cooling fluid passage into said hot gas passage.

2. A turbomachinery nozzle comprising:

a plurality of circumferentially spaced vanes; and a nozzle band including an annular wall extending generally laterally of said vanes and cooperating therewith to partially define a hot gas passage having a throat, the band having a portion upstream of the throat and another portion downstream of the throat, a serpentine conduit within the downstream portion for routing cooling fluid therethrough and to the portion upstream of the throat, and means for exhausting all of the cooling fluid from said serpentine conduit into the hot gas passage as a film along the wall upstream of the throat.

3. The turbomachinery nozzle as recited in claim 2 wherein said vanes are carried by said wall.

4. In a method of cooling a nozzle band partially defining a hot gas passage having a throat, the steps of:

routing cooling fluid through a nozzle band portion downstream of the throat; and further routing the cooling fluid back upstream of the throat; and exhausting the cooling fluid into the hot gas passage upstream of the throat.

5. The method of claim 4 wherein the cooling fluid comprises air.

6. In a gas turbine nozzle band having a wall bounding an annular stage of nozzle vanes and defining therewith a hot gas passage having a throat, said band characterized as having a portion extending generally laterally of the vanes upstream of the throat and another portion extending generally laterally of the vanes downstream of the throat, and an internal serpentine conduit for routing a coolant through the downstream portion to cool the downstream portion by the convection principle, the improvement comprising means for exhausting all of the coolant from said serpentine conduit into the hot gas passage as a coolant film along the wall upstream of the throat, thereby reducing momentum losses due to mixing.

7. The nozzle band as recited in claim 6 further comprising a generally radially projecting flange located at approximately the throat and having a pair of separated openings therethrough, one of said openings comprising a coolant entrance to said serpentine conduit and the other opening comprising an exit therefrom.

8. The nozzle band as recited in claim 7 further comprising a liner upstream of the flange and spaced from said hot gas passage defining wall for defining therewith a plenum and means for introducing coolant into said plenum and into impingement against said wall, thereby cooling said wall.

9. The nozzle band as recited in claim 8 wherein said exhausting means comprises a coolant pocket disposed between said wall and said liner and separated from said plenum by a rib extending substantially between said wall and said liner, and wherein the exit from said serpentine conduit terminates in said pocket, and further comprising apertures through said wall for exhausting coolant from said pocket and over said wall as a coolant film.

10. The nozzle band as recited in claim 8 wherein said liner also partially defines a cooling fluid passage for routing coolant to said nozzle band and wherein the entrance to said serpentine conduit communicates fluidly with said cooling fluid passage.

* * * * *

UNITED STATES PATENT AND TRADEMARK OFFICE

CERTIFICATE OF CORRECTION

PATENT NO. : 4,353,679

DATED : October 12, 1982

INVENTOR(S) : Ambrose A. Hauser

It is certified that error appears in the above—identified patent and that said Letters Patent is hereby corrected as shown below:

Column 6, claim 1, line 10, change "claim 22" to "claim 10"; and

Column 6, claim 4, line 33, delete "and".

Signed and Sealed this

*Seventeenth* Day of *April 1984*

[SEAL]

*Attest:*

GERALD J. MOSSINGHOFF

*Attesting Officer*

*Commissioner of Patents and Trademarks*